US010165795B2

(12) United States Patent
O'Malley

(10) Patent No.: US 10,165,795 B2
(45) Date of Patent: Jan. 1, 2019

(54) METHOD FOR MANUFACTURING CURVED EDGE CIGARETTE ROLLING PAPER

(71) Applicant: Curved Papers, Inc., Plainview, NY (US)

(72) Inventor: Michael O'Malley, Plainview, NY (US)

(73) Assignee: Curved Papers, Inc., Plainview, NY (US)

( * ) Notice: Subject to any disclaimer, the term of this patent is extended or adjusted under 35 U.S.C. 154(b) by 124 days.

(21) Appl. No.: 15/276,415

(22) Filed: Sep. 26, 2016

(65) Prior Publication Data

US 2017/0099869 A1 Apr. 13, 2017

Related U.S. Application Data

(63) Continuation-in-part of application No. 14/278,030, filed on May 15, 2014.

(60) Provisional application No. 61/976,036, filed on Apr. 7, 2014.

(51) Int. Cl.

| | |
|---|---|
| ***A24D 1/02*** | (2006.01) |
| ***B65B 27/08*** | (2006.01) |
| ***B65B 35/50*** | (2006.01) |
| ***B65B 61/00*** | (2006.01) |
| ***B65B 11/00*** | (2006.01) |

(Continued)

(52) U.S. Cl.

CPC ..... *A24D 1/022* (2013.01); *A24D 1/025* (2013.01); *B65B 11/004* (2013.01); *B65B 25/14* (2013.01); *B65B 27/08* (2013.01); *B65B 35/50* (2013.01); *B65B 61/005* (2013.01); *A24F 17/00* (2013.01)

(58) Field of Classification Search

None

See application file for complete search history.

(56) References Cited

U.S. PATENT DOCUMENTS

| | | | |
|---|---|---|---|
| 1,289,975 | A | 12/1918 | Waddell |
| 1,363,989 | A | 12/1920 | Morley |
| 4,114,629 | A | 9/1978 | Sedlacek et al. |

(Continued)

FOREIGN PATENT DOCUMENTS

| | | |
|---|---|---|
| DE | 819219 | 10/1951 |
| DE | 202004019112 | 4/2006 |

(Continued)

OTHER PUBLICATIONS

Translation of FR 620791 A, European Patent Office and Google, [online], retrieved from the Internet, [retrieved Mar. 16, 2018], <URL: https://worldwide.espacenet.com/?locale=EN_ep>.*

(Continued)

*Primary Examiner* — Dennis R Cordray

(74) *Attorney, Agent, or Firm* — Keusey & Associates, P.C.

(57) ABSTRACT

A method of manufacturing packaged curved edge cigarette rolling papers including stacking a cigarette rolling paper blanks to form a leaf stack. The leaf stack is enclosed within a folded cover to form a covered leaf stack. A band is wrapped around the covered leaf stack to hold the leaf stack in alignment with the cover while the cover and leaf stack is die cut to form packaged curved edge cigarette rolling papers. The curved edge is continuous arc, for example an elliptical arc which eliminates the corners that can interfere with cigarette hand rolling.

20 Claims, 10 Drawing Sheets

(51) Int. Cl.

| | |
|---|---|
| ***B65B 25/14*** | (2006.01) |
| *A24F 17/00* | (2006.01) |

(56) References Cited

U.S. PATENT DOCUMENTS

| | | | | |
|---|---|---|---|---|
| 5,060,675 | A | 10/1991 | Milford et al. | |
| 5,450,862 | A | 9/1995 | Baldwin et al. | |
| 5,505,109 | A * | 4/1996 | Okonski | B26D 3/12 83/622 |
| 5,878,754 | A | 3/1999 | Peterson et al. | |
| 6,138,684 | A | 10/2000 | Yamazaki et al. | |
| 8,701,681 | B2 | 4/2014 | Rasouli et al. | |
| 2009/0099869 | A1 * | 4/2009 | Darin | G06F 19/328 705/3 |

FOREIGN PATENT DOCUMENTS

| | | |
|---|---|---|
| FR | 620791 | 4/1927 |
| FR | 1109547 | 1/1956 |
| GB | 18827 | 12/1912 |

OTHER PUBLICATIONS

International Search Report and Written Opinion for International Stage PCT/US2015/023464 dated Jul. 15, 2015.

"Rolling Paper Sizes", Rolling Paper Warehouse, 2015, [online], retrieved from the internet, [retrieved Dec. 30, 2015], <URL: http://www.rollingpaperwarehouse.com/ROLLING-PAPER-SIZES_ep_45.html>.

* cited by examiner

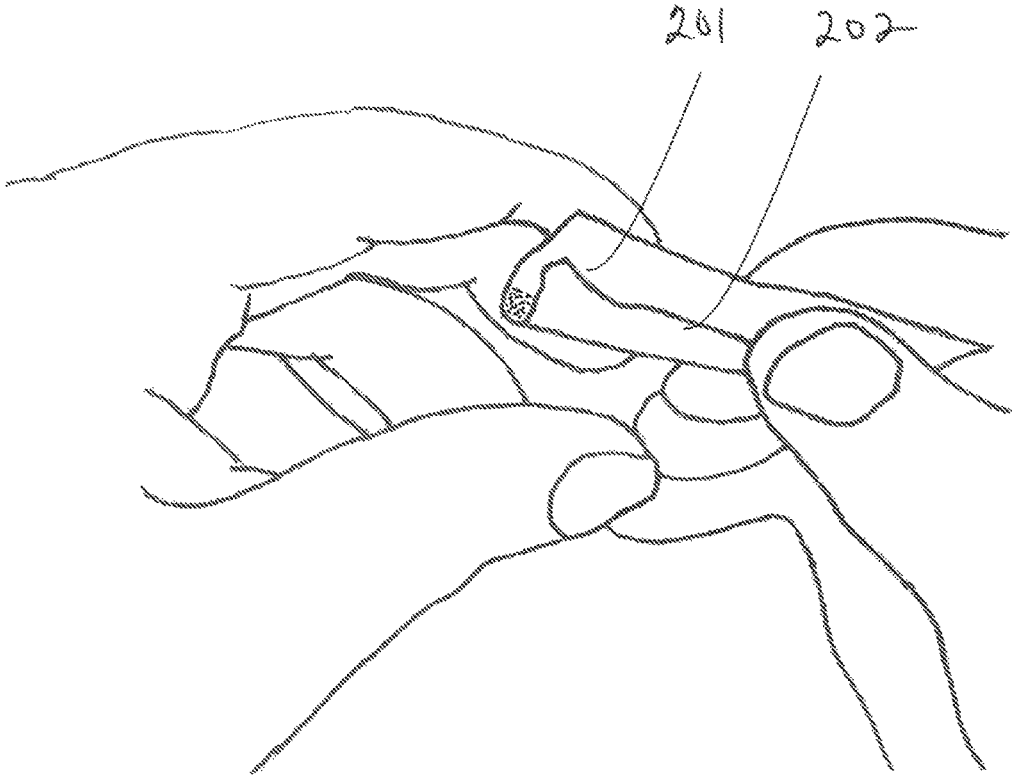
FIG. 4 - Prior Art

METHOD FOR MANUFACTURING CURVED EDGE CIGARETTE ROLLING PAPER

CROSS-REFERENCE TO RELATED APPLICATIONS

This application is a continuation-in-part of co-pending U.S. patent application Ser. No. 14/278,030 entitled EASY TO ROLL CURVED EDGE CIGARETTE ROLLING PAPER filed May 15, 2014, which claims the benefit under 35 U.S.C. § 119(e) from U.S. Provisional Patent Application No. 61/976,036 entitled EASY TO ROLL CURVED EDGE CIGARETTE ROLLING PAPER filed Apr. 7, 2014.

BACKGROUND OF THE INVENTION

1. Field of the Invention

The present invention relates generally to a method for manufacturing cigarette rolling papers and, more particularly, to a packaged cigarette rolling paper which has a curved edge which serves to facilitate rolling a cigarette with the paper, as it eliminates the corners of the traditional rectangular rolling paper, which become an obstacle if the top and bottom edges of the paper are not kept parallel to each other as the cigarette is rolled, a common problem.

2. The Prior Art

Conventionally cigarette rolling papers are rectangular thin tissue-like paper. The standard diameter of a cigarette is generally around 8 mm and the length also varies, but is on the order of 65 mm. Hand-rolling cigarettes is an ancient art, hundreds of years old, and requires some skill. There have been gadgets developed to make it easier. In both the cases of hand-rolling without any equipment, and with the common hand-rolling machines, which are built to feed common rectangular papers, there is a problem that the top and bottom edges of the paper have to be kept parallel, or the leading corner will bind up as you start to roll. Rectangular papers are easily created from a web by slitting to the appropriate width and then straight cutting the slit web to the appropriate length. The rectangular papers can then be stacked in standard rectangular packaging.

While certain non-rectangular rolling papers in individual form have been proposed, there has not been a disclosure of industrial scale methods to manufacture them. In addition, there is no teaching of customized non-rectangular packaging. Individual non-rectangular rolling papers are shown in U.S. Pat. No. 1,363,989 and GB 18,827 and FR 620,791 and DE 819,219 and FR 1,109,547. The references do not address how such papers may be produced on a commercial scale.

Another rolling paper design is shown in U.S. Pat. No. 1,289,975 entitled Cigarette Wrapper. The main rectangular rolling paper has a closure tongue 12 and a holding strip 14 extending off a lower corner thereof. The holding strip helps keep the tobacco in place while the paper is rolled. The closure tongue then prevents tobacco from coming out into the mouth of the user. A further rolling paper design is shown in U.S. Pat. No. 4,114,629 entitled Cigarette Rolling Paper with Integral Pouch. A pouch is formed at the lower edge of the rolling paper to hold the tobacco during rolling. Tear strips at either end allow the edges of the pouch to be removed after rolling to expose the tobacco. Both of these patents utilize extra material which can increase costs and detract from the cigarette enjoyment.

When rolling a cigarette, the user takes the flat paper and folds it to form a pouch in a u- or v-shape to hold the smoking material. The near and far edges are referred to hear as the bottom and top edges, respectively. The near edge is kept short, and has the edge that is tucked in to start the roll. The far edge, top, has the edge which seals the cigarette at the end when it is rolled up. The user rolls the near edge up into the far edge to form the final cylindrical cigarette shape. The top edge is often treated with glue to seal the cylinder, but that is sometimes omitted, on glueless papers, which self-seal when activated by moistening, typically with saliva.

Years ago, Zig-Zag, one of the venerable established cigarette rolling paper companies, came out with an innovation to address this problem, they produced papers with the corners cut off. People had done that for years, and it helped with this problem. It works well. The Zig-Zag KutKorners papers are still available. There have been no other successful designs to address this problem, nor many other innovations at all in this stable mature market since the Zig-Zag KutKorner papers came out.

There are EZ-wider papers, which are just larger and heavier rectangular papers, which allow you to get out of parallel and catch a corner and still just keep rolling up because there is so much paper. But smoking more paper is not desirable.

The Zig-Zag KutKorners are good, but the total elimination of the problem catching the corner of the rolling paper is desirable, and dramatically extends the primitive advantage of the Zig-Zag KutKorners, and individual discoverers of coin coupe as a folkway, cut corners, as regards rolling papers.

Accordingly, it would be desirable to provide an economical method for manufacturing large quantities of curved edge rolling papers.

In addition, it would be desirable to provide a custom sized package to allow consumers to readily identify the enclosed product.

Furthermore, it would be desirable to provide a manufacturing process to produce commercial quantities of prepackaged curved edge rolling papers that facilitates the rolling of cigarettes.

SUMMARY OF THE INVENTION

These and other related objects are achieved according to an embodiment of the invention involving a method of manufacturing packaged curved edge cigarette rolling papers. Initially a multiplicity of cigarette rolling paper blanks are stacked to form a leaf stack. The leaf stack is then enclosed within a folded cover to form a covered leaf stack having two opposed ends. A portion of said covered leaf stack is banded within a sleeve. One end of the covered leaf stack is cut to an while said sleeve retains the opposite end of said leaf stack in alignment with said folded cover to form packaged curved edge cigarette rolling papers.

The leaf stack includes a top face, a bottom face, a spine side and a trim side opposite said spine side. The cover is folded into three parts including a top flap, a spine flap and a bottom flap which completely overlie the top face, the spine side and the bottom face, respectively. The method further includes the step of creasing one of the top or bottom flaps to form a hinged access door. The access door hinges at one edge of the sleeve while the other end of the sleeve is aligned with the spine flap so that one leaf can be removed from the stack.

The sleeve retains the spine side of said leaf stack in alignment with the side flap of the cover during the cutting step. The enclosing step forms a rectangular covered leaf stack. The covered leaf stack includes a top panel, a bottom panel, a front edge and a back edge. The sleeve includes a top strip, a bottom strip, a front strip and a back strip that overlie the top panel, bottom panel, front edge and back edge, respectively, to form a banded covered leaf stack.

Prior to the cutting step the method further includes holding the banded covered leaf stack stationary by aligning the side flap against a fence while die cutting the top panel, the leaf stack and the bottom panel in one continuous pass against a support plate. Alternatively, prior to the cutting step the method further includes holding the banded covered leaf stack stationary by aligning the sleeve and the side flap against a fence while die cutting the top panel, the leaf stack and the bottom panel in one continuous pass against a support plate.

The method results in a packaged curved edge cigarette rolling paper. The curved edge is opposite the glued edge or unglued straight sealing edge in the case of glueless papers. The start and end points of the curve are on opposite sides of the paper, at a dimension approximately one-quarter (¼) of the target circumference of the cigarette being rolled from the cut edge. Constraining the region of the cut to the first quarter of the circumference minimizes waste paper while still the smoking material is well-supported by the full width of the paper as the curved edge is tucked into the far side of the pouch of smoking material. The curved edge 22 is then tucked into the bottom of the paper surface 20 on the opposite side of the packed cigarette and the roll-up is begun.

In a first embodiment of the invention, there is provided a cigarette rolling paper having one edge shaped as a convex curve and three straight edges. The curve is a generally smooth continuous arc with no significant corners or inflection points. The curve may be of various shapes for example a regular arc, an irregular arc, a circular arc, an oval arc and a complex arc.

The cigarette rolling paper is adapted to roll into a cigarette having a circumference, wherein said curve includes a deflection having a length approximately ¼ of the circumference. The curve deflection is proportional to the size of the rolling paper. The curve includes a midpoint that is located in the middle of the cigarette rolling paper. The curve includes one deflection at each end of the cigarette rolling paper.

The paper further includes glue at one end of the cigarette rolling paper opposite the curve. The cigarette rolling paper is adapted to roll into a cigarette beginning at the curve and ending at the glue end. The cigarette rolling paper comprises cigarette papers of any size or material.

According to a second embodiment, there is provided an apparatus for hand rolling a cigarette including a cigarette rolling paper having a generally rectangular shape with three rectilinear sides and a one curved side. The three rectilinear sides form three sides of a regular rectangle including (i) a first rectilinear side oriented perpendicular to a second rectilinear side, (ii) a third rectilinear side oriented perpendicular to the second rectilinear side, and (iii) the first rectilinear side being parallel to the third rectilinear side. The curved side is an elliptical arc having an arch height and an arch width that contacts the end points of the first and third rectilinear sides to form a closed figure. The cigarette rolling paper has reflective symmetry about a central axis that is collinear with the arc height.

The curved side is devoid of angular edges or sharp corners. The second rectilinear side has a width W, and the arc is part of an ellipse having a major axis, wherein the length of the major axis is between 1 and 10 times the width W. The first and third rectilinear sides have a length L minus deflection, and the arc is part of an ellipse having an arch height, wherein the length of the arch height is between ⅕ and ⅛ times the length L. The cigarette rolling paper is made from a material suitable for burning and human inhalation. Length L may also be considered the overall length of the paper from end-to-end.

The cigarette rolling paper has a thickness between about 0.25 mm and about 2.00 mm, a length L between about 60 mm and about 100 mm, and a width W between about 35 mm and about 45 mm. The elliptical arc is a geometric segment from an ellipse having a major axis that is between about 2 times and about 10 times the length of the minor axis. The region between the elliptical arc and the first and third rectilinear sides comprises a slope matched transition and includes a curvature different from the central portion of the elliptical arc. The cigarette rolling paper is made from a material selected from cellulose, plant fibers, rice, flax, hemp and tobacco.

BRIEF DESCRIPTION OF THE DRAWINGS

The advantages, nature, and various additional features of the invention will appear more fully upon consideration of the illustrative embodiments now to be described in detail in connection with accompanying drawings. In the drawings wherein like reference numerals denote similar components throughout the views:

FIG. 4 is a perspective view of rolling a cigarette with a prior art rectangular rolling paper.

DETAILED DESCRIPTION OF THE PREFERRED EMBODIMENTS

Figure 1:
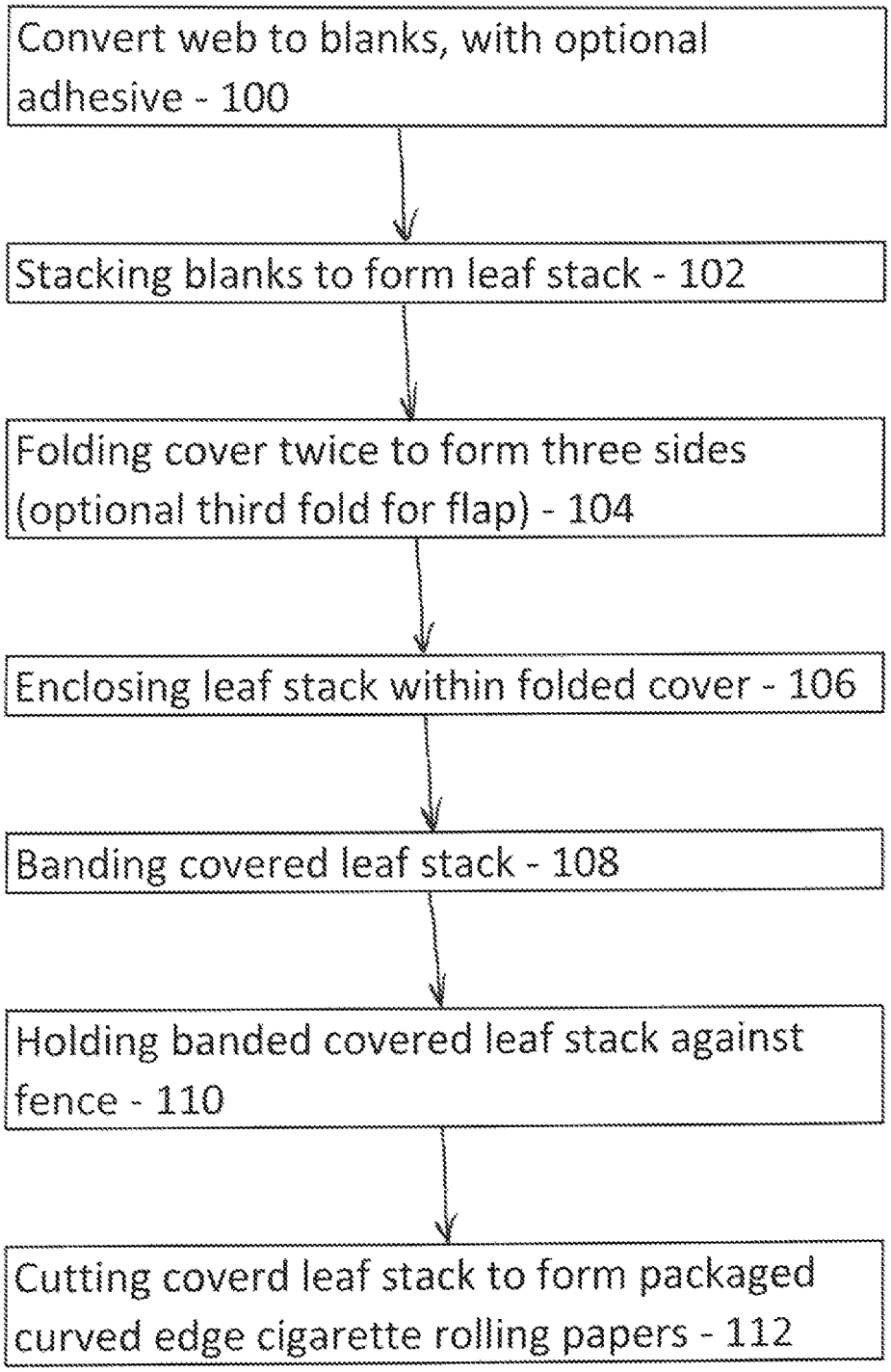
FIG. 1 is a flowchart showing the steps in the manufacturing process according to the invention.

Referring now in detail to the drawings, and in particular FIG. 1, there is shown a flowchart detailing the steps according an embodiment of a method according to the invention for manufacturing packaged curved edge cigarette rolling papers. A spool of paper, also known as a web, is converted to blanks. Typically the web is unspooled and cut into rectangular blanks. A narrow strip of adhesive may be applied to one edge of the blank. The method can produce rolling papers with or without adhesive. The process of transforming the web into blanks is referred to as step 100 converting web to blanks.

The blanks are stacked in step 102 to form a leaf stack. The leaf stack may contain between several dozen to 100+ blanks. In practical applications of the method, the leaf stack contained 50 blanks. The method can be employed with a greater or lesser number of blanks. A cover of pre-printed lightweight cardboard is provided. The cover is folded twice in step 104 to form three sides. A separate folding step is employed to symmetrically fold the rectangular cover with a narrow spine flap and two equally sized top and bottom panels. A further fold or crease may be formed across one of the panels. The leaf stack is enclosed within the folded cover in step 106. A band is formed from a pre-printed lightweight cardboard material that is folded into a loop or sleeve. A portion of the leaf stack is banded within the sleeve in step 108. The banded covered leaf stack is held against a fence in step 110. The covered leaf stack is cut to form packaged curved edge cigarette rolling papers 112.

Figure 2A:
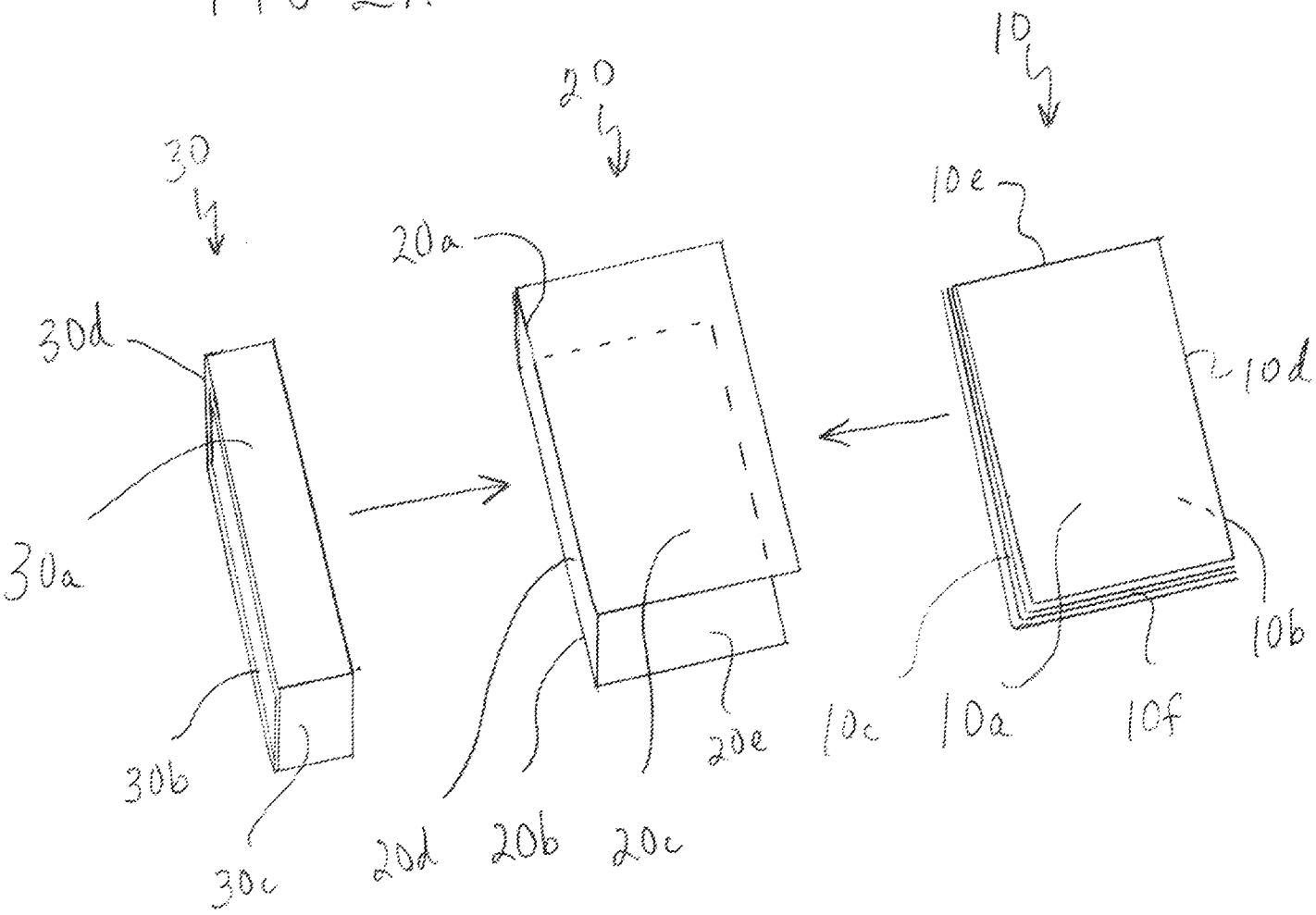
FIG. 2A is a perspective view showing the leaf stack, cover and sleeve.

The leaf stack, cover and sleeve that are processed according the method are shown in FIG. 2A. Leaf stack 10 is composed of several dozen blanks, for example, 50 blanks. The leaf stack includes a top face 10*a*, a bottom face 10*b*, a spine side 10*c*, a trim side 10*d*, a back side 10*e* and a front side 10*f*. Cover 20 is formed from pre-printed rectangular cardboard that has a first fold 20*a* and a second fold 20*b* resulting in a top flap 20*c*, a spine flap 20*d* and a bottom flap 20*e*. One of the flaps 20*c* or 20*e* may include a fold to form a hinged access door. Cover 20 is sized and configured to cover three sides of leaf stack 10. More particularly, top flap, spine flap and bottom flap will completely overlay the top face, spine side and bottom face of the leaf stack. Sleeve 30 is formed from pre-printed cardboard folded at four corners with the ends glued together. Sleeve 30 includes a top strip 30*a*, a bottom strip 30*b*, a front strip 30*c* and back strip 30*d*.

Figure 2B:
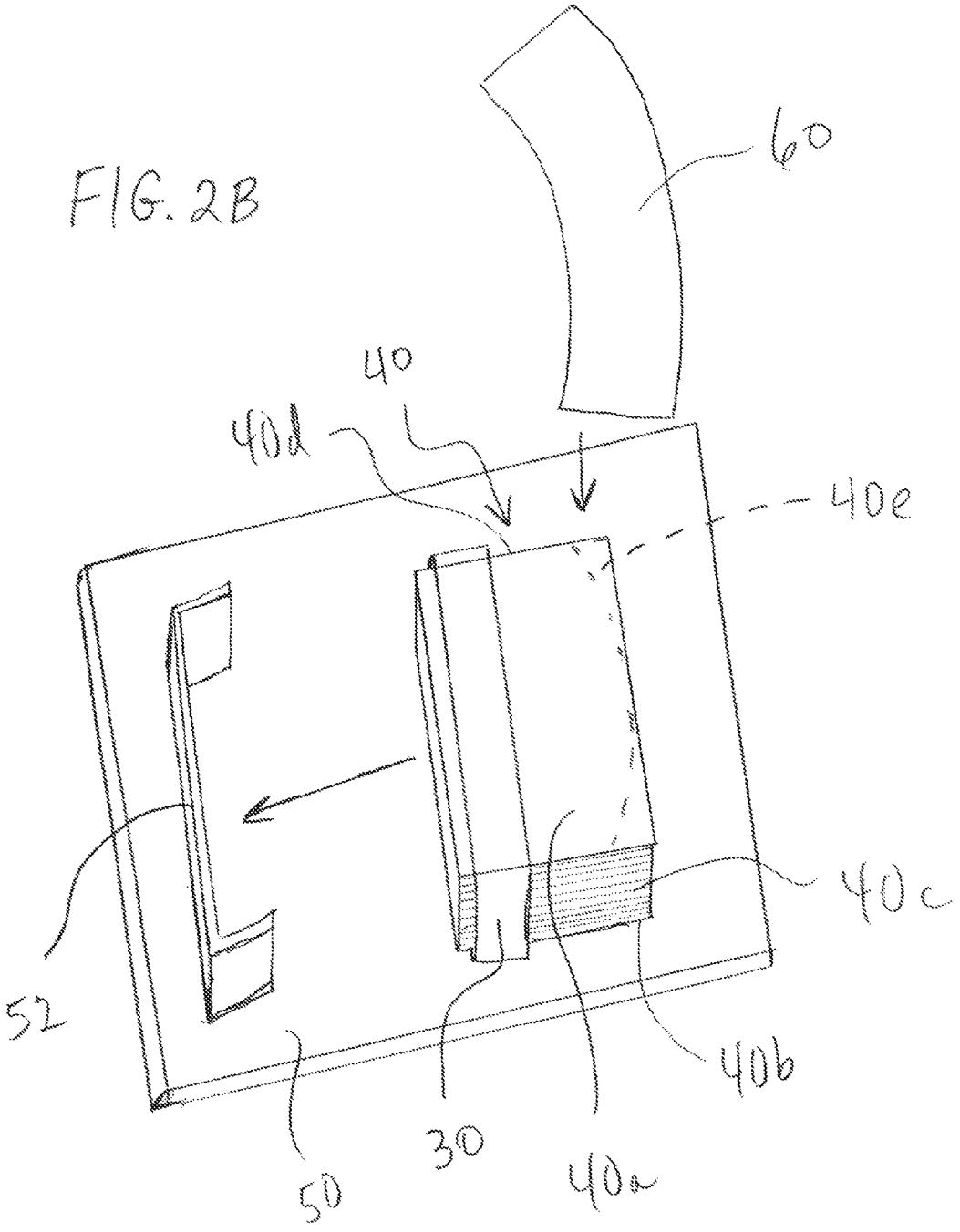
FIG. 2B is a schematic diagram showing the aligning and cutting steps.

Leaf stack 10 is tucked into cover 20 and then banded with sleeve 30. The resulting banded, covered leaf stack 40 is shown in FIG. 2B. The sleeve holds the cover closed to retain the leaf stack in alignment during the cutting operation. The four parts of the sleeve contact four sides of the covered leaf stack 40, as follows; the sleeve top strip, bottom strip, front strip and back strip overlie the covered leaf stack's top panel 40*a*, bottom panel 40*b*, front edge 40*c* and back edge 40*d*, respectively.

The banded covered leaf stack is fixture within a jig comprised of a support plate 50 and a fence 52. Fence 52 may be a single backstop, or more ideally a three-sided wall that surrounds the spine flap 20*d* and holds the banded covered leaf stack in a place. A curved cutting die 60 slices through the entire covered leaf stack 40 along the cutting line 40*e*. The cutting element may comprise a steel rule die and a clicker press. Other paper cutting tools may be used with a pneumatic or hydraulic press.

Figure 3A:
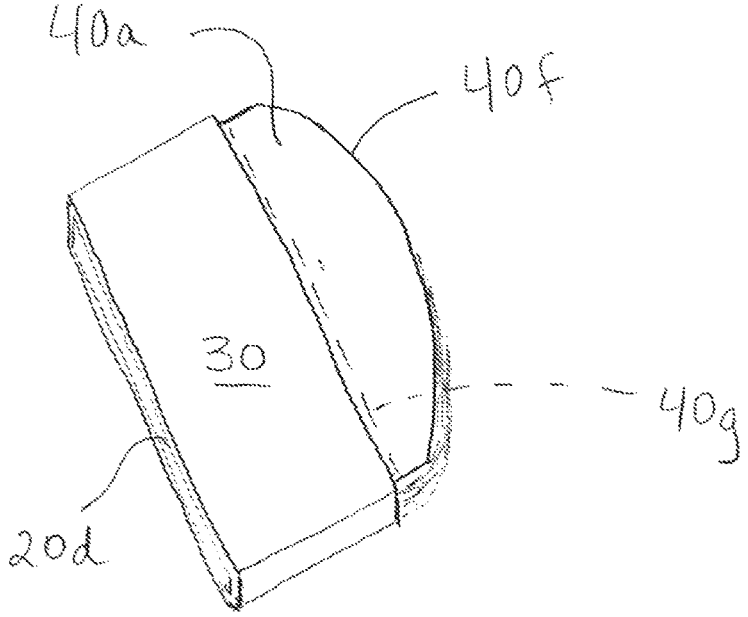
FIG. 3A is a perspective view of the cut covered leaf stack.
Figure 3B:
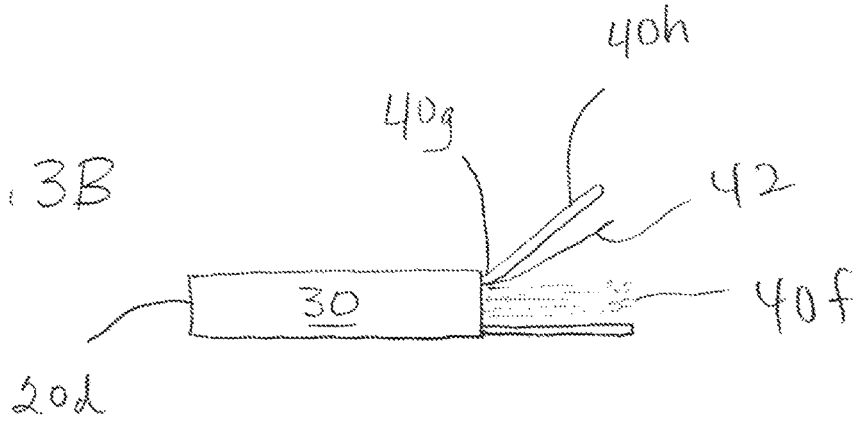
FIG. 3B is a front side elevational view of the cut covered leaf stack with the access door hinged open.

The resulting manufactured product is packaged curved edge cigarette rolling papers as shown in FIGS. 3A and 3B. After the cutting step, the covered leaf stack has a cut curved composite edge 40*f* comprised of top panel, bottom panel and the leaf stack all trimmed along a common edge. One or more covered leaf stacks may be cut in one pass. The covered leaf stacks may be conveyed to the cutting station, and conveyed from the cutting station to be master boxed.

Cover 20 may be provided with a further fold or crease 40*g*. Crease 40*g* is formed parallel to folds 20*b* and 20*c*. As can be seen in FIGS. 3A and 3B, the left edge of sleeve 30 is aligned with spine flap 20*d*. Crease 40*g* is positioned at the right edge of sleeve 30 to form a hinged access door 40*h*. FIG. 3B illustrates how hinged access door 40*h* is pivoted upward. The access door extends from the right edge of sleeve 30 to include the entire cut curved composite edge 40*f*. Hinged access door 40*h* could be provided on the top flap, bottom flap, or both. The combination of sleeve 30 and hinged access panel 40*h* allows a single rolling paper leaf 42 to be removed while the sleeve holds the remainder of the leaf stack. This configuration allows the covered leaf stack to be formed without the use of adhesive at the spine.

Figure 5:
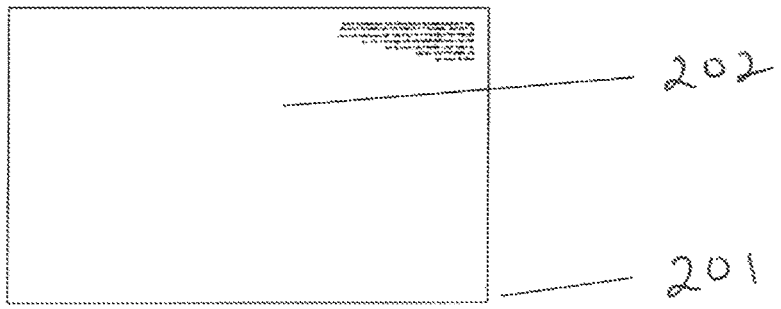
FIG. 5 Prior Art
FIG. 5 is a top plan view of a prior art rolling paper having a rectangular shape.
Figure 6:
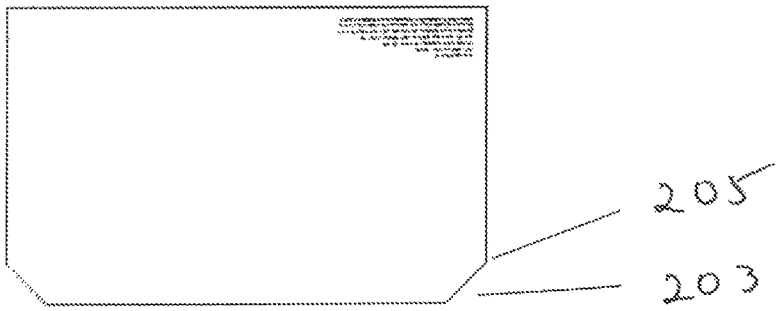
FIG. 6 Prior Art
FIG. 6 is a top plan view of a prior art rolling paper have cut corners.

The invention produces packaged cigarette papers having a curved edge which makes that edge very easy to tuck in and roll up. In a rolling process using a prior art rectangular paper 202 as shown in FIG. 4, the leading corner 201 of the bottom edge of rectangular paper 202, has caught and is not tucking in. FIG. 5 shows this paper laid out flat with the conventional corner 201 having a right angle. FIG. 6 shows an improved paper design where a section has been cut from corner 205 thereby eliminating the corner at the tucking edge 203. However, corner 205 still has two angular edges or sharp corners on each side that can bind if the rolling paper is not perfectly aligned at the outset of the rolling process.

Figure 7:
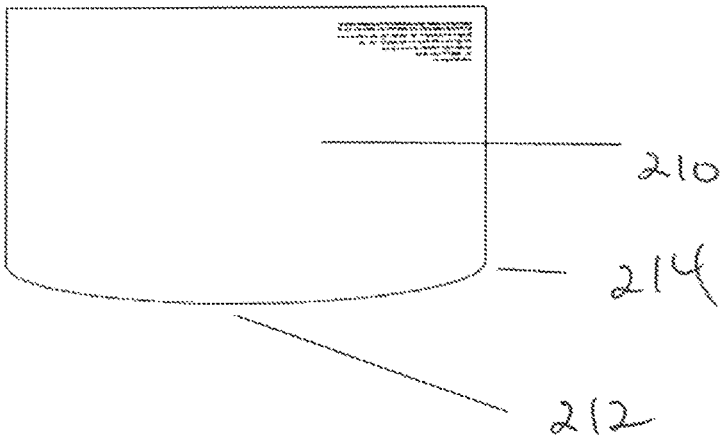
FIG. 7 is a top plan view of an embodiment of a rolling paper with a curved edge according to the invention.

FIG. 7 shows a rolling paper or paper 210, having a curved edge 212 according to an embodiment of the invention. Note that in the corner region 214 there are no longer angular edges or sharp corners. Curved edge 212 is the starting edge or tucking edge, used to begin the rolling process. The curved tucking edge 212 is the most elegant solution to provide the optimal tolerance for the normal not quite straight hand rollup.

Figure 8:
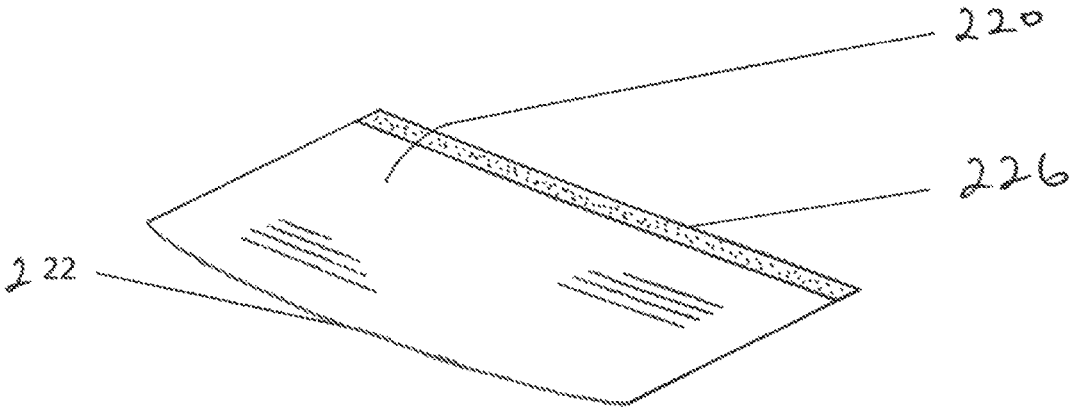
FIG. 8 is an isometric view of the rolling paper according to the invention with an adhesive strip opposite the curved edge.
Figure 9:
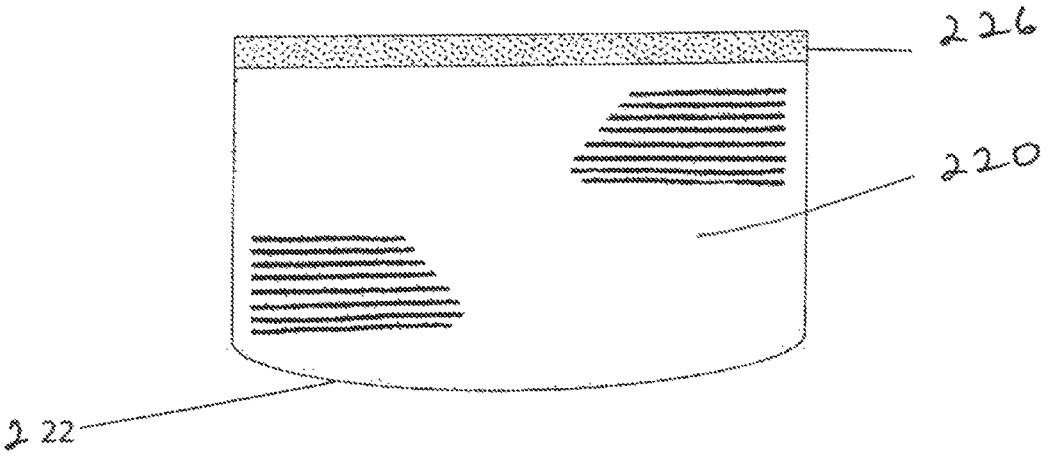
FIG. 9 a top plan view of the rolling paper according to the invention with an adhesive strip opposite the curved edge.

FIGS. 8 and 9 show a further embodiment of the curved edge 222 of the invention formed on paper 220 having a strip of glue 226 at the sealing edge. The presence of glue is an optional feature. The curved edge works equally well on both plain and glued papers. The curved edge is designed to facilitate the beginning of the rolling process. The glue is used at the end of the rolling process.

Figure 10:
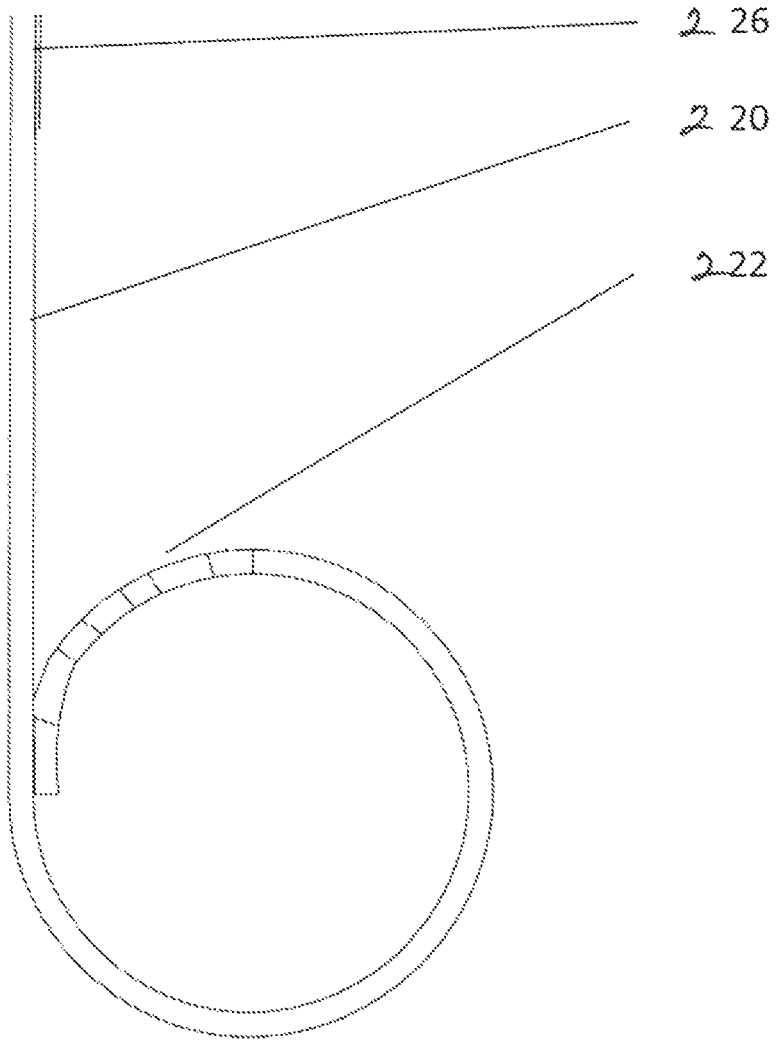
FIG. 10 is a side elevational view of the rolling paper according to the invention with the first roll formed.
Figure 11:
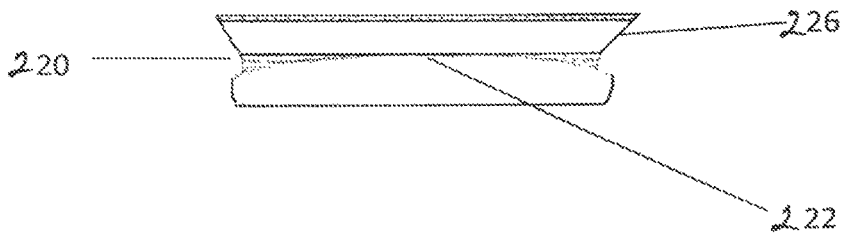
FIG. 11 is a front side elevational view of the rolling paper according to the invention with the first roll formed.

FIG. 10 shows a side view of the initial roll, without tobacco for the sake of clarity. The roll forms a cylinder having a circumference. The curved edge 222 is shown as extending from the 9:00 position to the 12:00 position. Thus the curved edge 222 extends ¼ of the circumference of the cigarette. Any smooth curve in this region will assist to make rolling easier, but the ¼ dimension is optimal. The specific character and dimensions of the curve are determined by the overall dimensions of the paper, and this invention works for any size paper or material. FIG. 11 shows the middle point of the arc 222 has been tucked into the far edge of the paper 220 as the rolling begins. Since the paper curves away from the middle point toward the edge of the paper, there is less material present at the troublesome corners, and the likelihood of binding is greatly reduced or eliminated. The adhesive 226 will be contacted when the cylindrical roll has reached the top of paper 220.

The paper according to the invention includes a smooth curved edge on one side of an otherwise rectangular shape. The curved edge may have a variety of geometries contemplated by the invention, for example, circular, oval or arc shaped.

Figure 12:
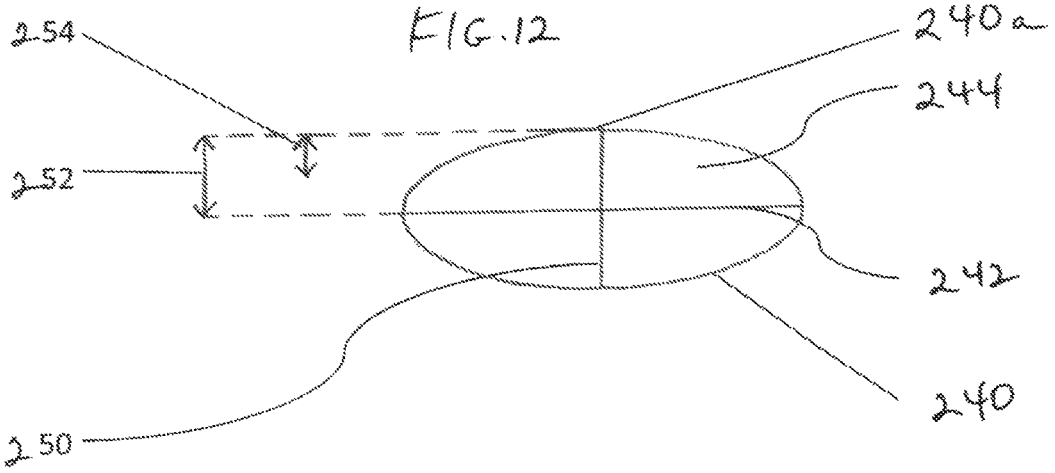
FIG. 12 is a diagram showing the geometry of the elliptical arc.

In one embodiment the curved edge has an elliptical shape. FIG. 12 shows an ellipse 240 having a major axis 242 across the widest section of the ellipse and a minor axis 250 across the narrowest section of the ellipse. The major axis 242 corresponds to a first arch height of 252 measured orthogonal from the major axis 242 to the top 240*a* of the ellipse. The arch width 244 corresponds to a second arch height 254 measured orthogonal from the arch width 244 to the top 240*a* of the ellipse. The curved edge of the invention may include any shape from the major axis 242 up to the top 240*a* of the ellipse.

Figure 13:
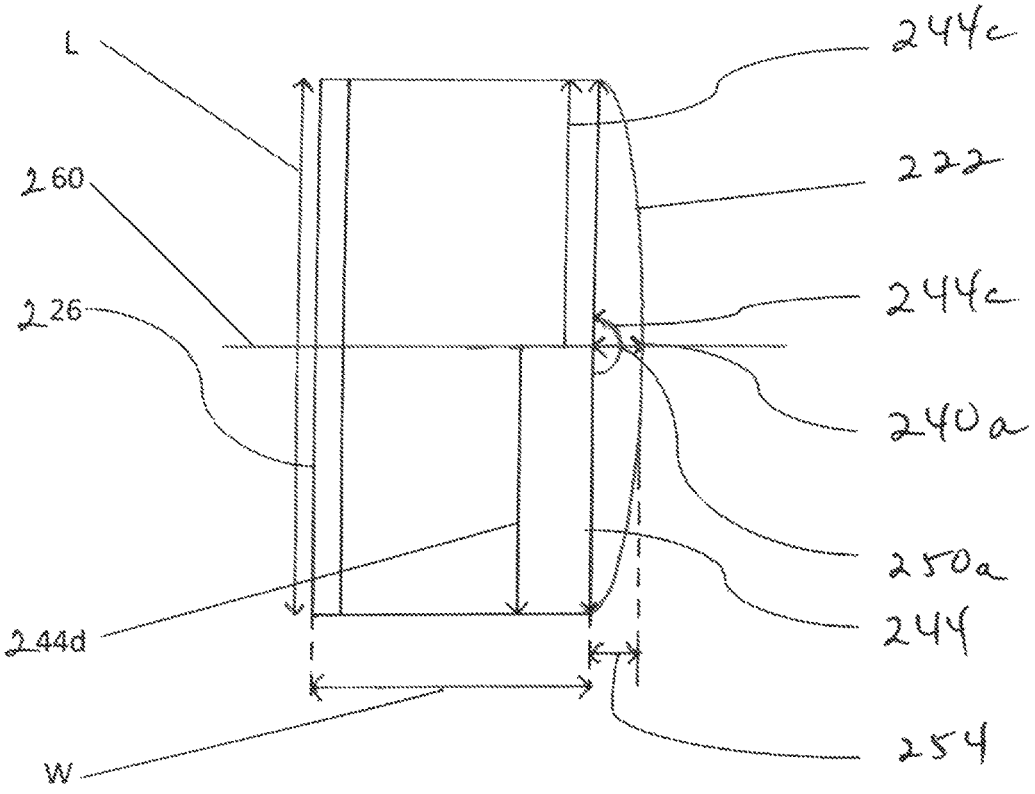
FIG. 13 is a schematic drawing showing the relationships between the elliptical arc and the paper.

FIG. 13 illustrates the section above arch width 244 to top 240*a* as comprising the curved edge 222 of paper 220. Curved edge 222 represents the bottom of the paper where the tobacco is placed and the rolling process begins. The left side of paper 220 optionally includes adhesive 226 to seal the cigarette once the rolling process is complete. A minor axis segment 250*a*, which represents the largest dimension of the curve is located in the center of paper 220. More particularly, minor axis segment 250*a* extends collinear to line 260 which represents an axis of symmetry for paper 220. In other words, if paper 220 is folded along line 260, the two halves will have an identical shape. It is axiomatic that the central angle 244*a* of the arch width 244 is 180 degrees. The first arch width segment 244*c* extending orthogonal from line 260 to the right edge of paper is equal in length to the second arch width segment 244*d* extending orthogonal from line 260 to the opposite left edge of paper 220.

Paper 220 includes a width W. The curved edge is a section from an ellipse. The ellipse includes a major axis. The major axis 242 has a length that is between 1 and 10 times longer than width W. Note the relationship of width W is in comparison to the major axis, even when a narrower arch width is used on the actual paper. Ellipses may be selected from the group having a major axis that is between 2 and 10 time the length of the minor axis. The region between the elliptical arc 222 and the first and third rectilinear sides may have a smooth rounded transition which may be slope shaped or filleted. This rounded transition or fillet may have a curvature different than the central portion of the elliptical arc.

Paper 220 includes a length L. In general, the length L will be greater than the width W. At the shortest, assume W is five units in width, and the paper will be rolled one and one-quarter revolutions, with one revolution taking up four units. The resulting cigarette will have a circumference of 4 units, with a one unit overlap. Arch height 254, following the formula of ¼ the circumference, would be 1 unit long, or ⅕ of width W. At the longest, assume W is eight units in width, and the paper will be rolled two complete revolutions, with each revolution taking up four units. The resulting cigarette will have a double wall and a circumference of 4 units. Arch height 254, following the formula of ¼ the circumference, would be 1 unit long. Accordingly, arch height 254 will be between ⅕ and ⅛ of width W. The arch height 254 is also referred to as the curve deflection.

This invention relates to the configuration of a rolling paper, and can be applied to rolling papers of any type. By way of example only, rolling papers are made from cellulose, plant fibers, rice, flax, hemp and tobacco. When made from cellulose, a synthetic or natural polymer may be selected. Several patents disclose the composition of rolling papers as follows: U.S. Pat. Nos. 5,060,675 and 5,450,862 and 5,878,754 and 6,138,684 and 8,701,681 the contents of which are incorporated herein by reference thereto. Rolling papers have a thickness on the order of several millimeters, or less than one millimeter, for example between 0.025 and 0.0025 mm. The rolling papers may be manufactured in a sheet or web of indefinite length. The rolling papers may be cut from the web by die-cutting, stamping or any other suitable means. The length L can range between about 60 mm and about 100 mm, and the width W can range between about 35 mm and about 45 mm. The curved edge can be formed by trimming a rectangular paper.

Having described preferred embodiments for (which are intended to be illustrative and not limiting), it is noted that modifications and variations can be made by persons skilled in the art in light of the above teachings. The covered leaf stack may be of various rectangular configurations. The cutting step may be selected from cutting or trimming operations known within the paper industry. In the resulting product, the curved edge can be of various geometries as long as the central portion is longer than the end portions. Oval or elliptical shapes are ideally suited, but other regular, irregular or compound curves may be employed as long as the transition between the curved edge and the rectilinear side edges is smooth without sharp corners. The use of any rolling paper material, composition and manufacturing methods are intended to be included within the scope of the invention. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims

What is claimed is:

1. A method of manufacturing packaged curved edge cigarette rolling papers comprising the steps of:

stacking a multiplicity of rectangular cigarette rolling paper blanks to form a leaf stack having a top face, a bottom face opposing said top face, a front side, a back side opposing side front side, a spine side and a trim side opposing said spine side;

enclosing said leaf stack within a three sided folded cover which completely overlies the top face, spine side and bottom face to form a covered leaf stack having a trim end and an opposed spine end;

banding a portion of said covered leaf stack within a sleeve that wraps around the covered leaf stack overlying the top and bottom faces and contacting the front and back sides; and cutting the cover and leaf stack at the trim end while said sleeve retains the leaf stack in alignment with said folded cover to form packaged curved edge cigarette rolling papers.

2. The method of claim 1, wherein said cover is folded into three parts including a top flap, a spine flap and a bottom flap which completely overlie said top face, said spine side and said bottom face, respectively.

3. The method of claim 2, wherein said sleeve wraps around the top flap and bottom flap of the cover to retain the spine side of said leaf stack in alignment with said spine flap of said cover during said cutting step, and wherein said enclosing step forms a rectangular covered leaf stack.

4. The method of claim 3, wherein the method further includes the step of creasing said top flap to form a hinged access door which hinges at one edge of said sleeve while the opposed edge of said sleeve is aligned with said spine flap, wherein opening the access door exposes the top face of the leaf stack so that one leaf can be removed from said stack.

5. The method of claim 2, said sleeve includes a top strip that overlies the top flap of the cover, a bottom strip that overlies the bottom flap of the cover, a front strip that extends down from the top strip to the bottom strip and a back strip that extends up from the bottom strip to the top strip to form a banded covered leaf stack.

6. The method of claim 5, wherein prior to said cutting step the method further includes holding said banded covered leaf stack stationary by aligning said spine flap against a fence.

7. The method of claim 6, wherein said cutting step includes die cutting said top flap, said leaf stack and said bottom flap at the trim end in one continuous pass to form a cut curved composite edge.

8. The method of claim 1, wherein said cutting step converts each of said cigarette rolling paper blanks from a rectangle to a cigarette rolling paper comprising one edge shaped as a convex curve, and three straight edges.

9. The method of claim 8, wherein said curve is a generally smooth continuous arc with no significant corners or inflection points.

10. The method of claim 9, wherein said curve is selected from the group consisting of a regular arc, an irregular arc, a circular arc, an elliptical arc and a complex arc.

11. The method of claim 10, wherein the cigarette rolling paper is adapted to roll into a cigarette having a circumference, wherein said curve includes an arch height measured from the trim end having a length approximately ¼ of the circumference.

12. The method of claim 11, wherein said an arch height is proportional to the length of spine side of the rectangle of said rolling paper blank.

13. The method of claim 8, wherein each of said cigarette rolling paper blanks includes a strip of adhesive on one face adjacent said spine side.

14. The method of claim 13 wherein the cigarette rolling paper is adapted to roll into a cigarette beginning at said curve and ending at said adhesive strip at the spine side.

15. The method of claim 8, wherein each of the cigarette rolling paper blanks has a thickness between about 0.025 mm and about 0.0025 mm, a length L of the spine side between about 60 mm and about 100 mm, and a width W perpendicular to the spine side between about 35 mm and about 45 mm, and wherein the cigarette rolling paper is made from a material suitable for burning and human inhalation.

16. The method of claim 1, wherein said cutting step converts each of said cigarette rolling paper blanks from a rectangle to an apparatus comprising:

a cigarette rolling paper having a generally rectangular shape with three rectilinear sides and a one curved side;

said three rectilinear sides form three sides of a regular rectangle comprising (i) a first rectilinear side oriented perpendicular to a second rectilinear side, (ii) a third rectilinear side oriented perpendicular to said second rectilinear side, and (iii) said first rectilinear side being parallel to said third rectilinear side; and said curved side comprising an elliptical arc having an arch height and an arch width that contacts the end points of said first and third rectilinear sides to form a closed figure;

wherein said cigarette rolling paper has reflective symmetry about a central axis that is collinear with the arch height.

17. The method of claim 16, wherein the first and third rectilinear sides each have a width W, and the arc is part of an ellipse having a major axis, wherein the length of the major axis is between 1 and 10 times the width W.

18. The method of claim 17, wherein the first and third rectilinear sides have a width W that is the width of the rolling paper blank minus the arch height, wherein the length of the arch height is between ⅕ and ⅛ times the width W.

19. The method of claim 18, wherein the region of contact between the elliptical arc and the first and third rectilinear sides includes a curvature different from the central portion of the elliptical arc.

20. The method of claim 19, wherein the elliptical arc is a geometric segment from an ellipse having a major axis that is between about 2 times and about 10 times the length of the minor axis.

* * * * *